US010100618B2

(12) United States Patent
Sales et al.

(10) Patent No.: US 10,100,618 B2
(45) Date of Patent: Oct. 16, 2018

(54) BORE CONNECTOR ENGAGEMENT TECHNIQUE

(71) Applicant: OneSubsea IP UK Limited, London (GB)

(72) Inventors: Alessandro Sales, Taubate (BR); Jefferson Rodrigo Marcelino Dos Santos, Pindamonhangaba (BR); Akshay Kalia, Houston, TX (US); Alireza Shirani, Houston, TX (US); Sergio Yamahata, Macae (BR); Marcus Lara, Cypress, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/494,865

(22) Filed: Apr. 24, 2017

(65) Prior Publication Data

US 2017/0328176 A1 Nov. 16, 2017

Related U.S. Application Data

(60) Provisional application No. 62/334,801, filed on May 11, 2016.

(51) Int. Cl.

| | |
|---|---|
| ***E21B 41/00*** | (2006.01) |
| ***E21B 43/017*** | (2006.01) |
| ***E21B 33/038*** | (2006.01) |

(52) U.S. Cl.

CPC ..... *E21B 41/0007* (2013.01); *E21B 33/038* (2013.01); *E21B 43/017* (2013.01)

(58) Field of Classification Search

CPC ... E21B 33/038; E21B 41/0007; E21B 43/017

See application file for complete search history.

(56) References Cited

U.S. PATENT DOCUMENTS

| | | | | |
|---|---|---|---|---|
| 4,878,783 | A * | 11/1989 | Baugh | E21B 33/0355 166/344 |
| 7,380,835 | B2 | 6/2008 | McCoy et al. | |
| 8,267,179 | B2 * | 9/2012 | Butcher | E21B 43/0107 166/341 |
| 9,163,486 | B2 | 10/2015 | Lugo | |
| 2004/0127084 | A1 * | 7/2004 | Glennie | E21B 33/0385 439/316 |
| 2008/0007064 | A1 * | 1/2008 | McCoy | E21B 41/0007 285/402 |
| 2008/0202760 | A1 * | 8/2008 | Cosgrove | E21B 33/038 166/341 |
| 2010/0186964 | A1 * | 7/2010 | Reid | E21B 33/038 166/341 |

(Continued)

*Primary Examiner* — James G Sayre

(74) *Attorney, Agent, or Firm* — Brandon S. Clark

(57) ABSTRACT

A technique for engaging a bore connector with a receptacle on subsea equipment. The technique may include providing an operator with a visual indication of acceptable alignment between the connector and the receptacle in advance of attaining engagement. In this way, a proper and reliably sealed engagement may be achieved. Further, the bore connector and techniques for use thereof include added indication of completed sealed engagement sufficient for testing and/or operational use of the connector in supporting a fluid application directed at the equipment through the receptacle.

18 Claims, 6 Drawing Sheets

(56) References Cited

U.S. PATENT DOCUMENTS

| | | | | |
|---|---|---|---|---|
| 2013/0146301 | A1* | 6/2013 | Lugo | E21B 43/013 166/344 |
| 2014/0262304 | A1* | 9/2014 | Bushman | E21B 41/0007 166/335 |
| 2014/0361534 | A1* | 12/2014 | Bekkevold | E21B 43/013 285/315 |
| 2017/0205012 | A1* | 7/2017 | Nyfelt | E21B 33/038 |

* cited by examiner

BORE CONNECTOR ENGAGEMENT TECHNIQUE

CROSS REFERENCE TO RELATED APPLICATION(S)

This Patent Document claims priority under 35 U.S.C. § 119(e) to U.S. Provisional Application Ser. No. 62/334,801, entitled Bore Connection System, filed on May 11, 2016, which is incorporated herein by reference in its entirety.

BACKGROUND

Exploring, drilling and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to land based oilfields accommodating wells of limited depth, it is not uncommon to find offshore oilfields with wells exceeding tens of thousands of feet in depth. Furthermore, today's hydrocarbon wells often include a host of lateral legs and fractures which stem from the main wellbore of the well toward a hydrocarbon reservoir in the formation.

Such subsea oilfields may accommodate a host of permanently installed equipment at the seabed. For example, in addition to wellhead Christmas tree assemblies and other architecture directly at each well, a host of pumps, manifolds, storage units and other equipment may be distributed about the oilfield according to the designated layout for the site.

As with any other oilfield equipment, whether on or off land, the periodic need for interventional maintenance may arise. Fortunately, in a large number of these circumstances, controlled fluid access alone may be sufficient to carry out the maintenance. That is, rather than pulling large scale equipment from the seabed to surface for hands on maintenance, it may be sufficient to hook up a hydraulic line to the equipment at the seabed and proceed with a service application. For example, a manifold at the seabed may be in need of a cleanout application. Thus, a diver or ROV (remote operated vehicle) may hook up a hydraulic line to the equipment and then a chemical injection application run to clean out the manifold.

Unfortunately, hooking up a hydraulic line to the equipment may be much easier said than done. For example, with ever increasing depths, the use of a diver for hands on installation is less practical, both in terms of the increased hazards and complexity. Further, even where an ROV is utilized, complexity and challenges remain when the effort to mate a small bore connector to a receptacle at a large piece of equipment.

An ROV may tightly secure a tubular small bore connector of perhaps about 2 inches or so in diameter and a few inches longer in length. The ROV may then be remotely guided toward the receptacle of the equipment as noted above. However, keep in mind that dragging from behind the connector is an extended, fluid filled, hydraulic line. The line may run several hundred feet toward a tank at the seabed or further, to a vessel at the surface where the chemical treatment fluid is stored. Regardless, a disorienting drag or torque is placed at one end of the connector which can have an impact on the ability of the ROV to properly align and engage the connector with the receptacle.

When the connector and receptacle are not properly engaged due to the failure of alignment, the possibility of seal failure is increased. Failure of the seal may not only lead to failure of the application but more serious consequences. For example, in the situation described, chemicals used for cleanout of a manifold may be spilled into seawater resulting in environmental hazards. Once more, failure of the seal may also result in damage to the equipment being serviced. That is, the lack of a seal not only means that the fluid from the line does not end up exclusively where intended, it also means that seawater may contaminate the equipment as well. Even if contamination of the equipment with an unintended influx of seawater does not ruin the equipment, it is still likely to result in the need for some level of inspection and/or repair. As a result, operations may be shut down until replacement equipment may be acquired and deployed if available. All in all, the cost of such replacement due to delays in operations may be in the millions of dollars, simply due to the failure to properly install a handheld size bore connector at a piece of equipment on the seabed.

Efforts have been undertaken to improve the reliability of such connector equipment mating. However, there remains no effective manner of ensuring proper alignment for sake of engagement and sealing. For example, currently available connectors are generally mated to the receptacle of the equipment through more of a stabbing technique without any advance focus on alignment. Further, even those that do not utilize such a stabbing technique still do not provide any manner of verifying proper alignment in advance of attaining full engagement. Thus, a substantial risk of misalignment and eventual seal failure remains.

SUMMARY

A method of engaging a bore connector to a receptacle of subsea equipment. The method includes first aligning and verifying the alignment of the connector with the receptacle. The connector may then be engaged with the receptacle after the verifying, the engagement sufficient to anchor and seal the connector at the receptacle.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments are described with reference to certain subsea operations utilizing manifolds requiring service. For example, chemical injection clean-out of a manifold used to service a cluster of wells at a seabed is described. However, a variety of different subsea applications may take advantage of the unique techniques for sealably engaging a bore connector with a subsea equipment receptacle as detailed herein. Indeed, so long as a technique of verifying alignment in advance of completed engagement of the connector to the receptacle is provided, appreciable benefit may be realized.

Figure 1:
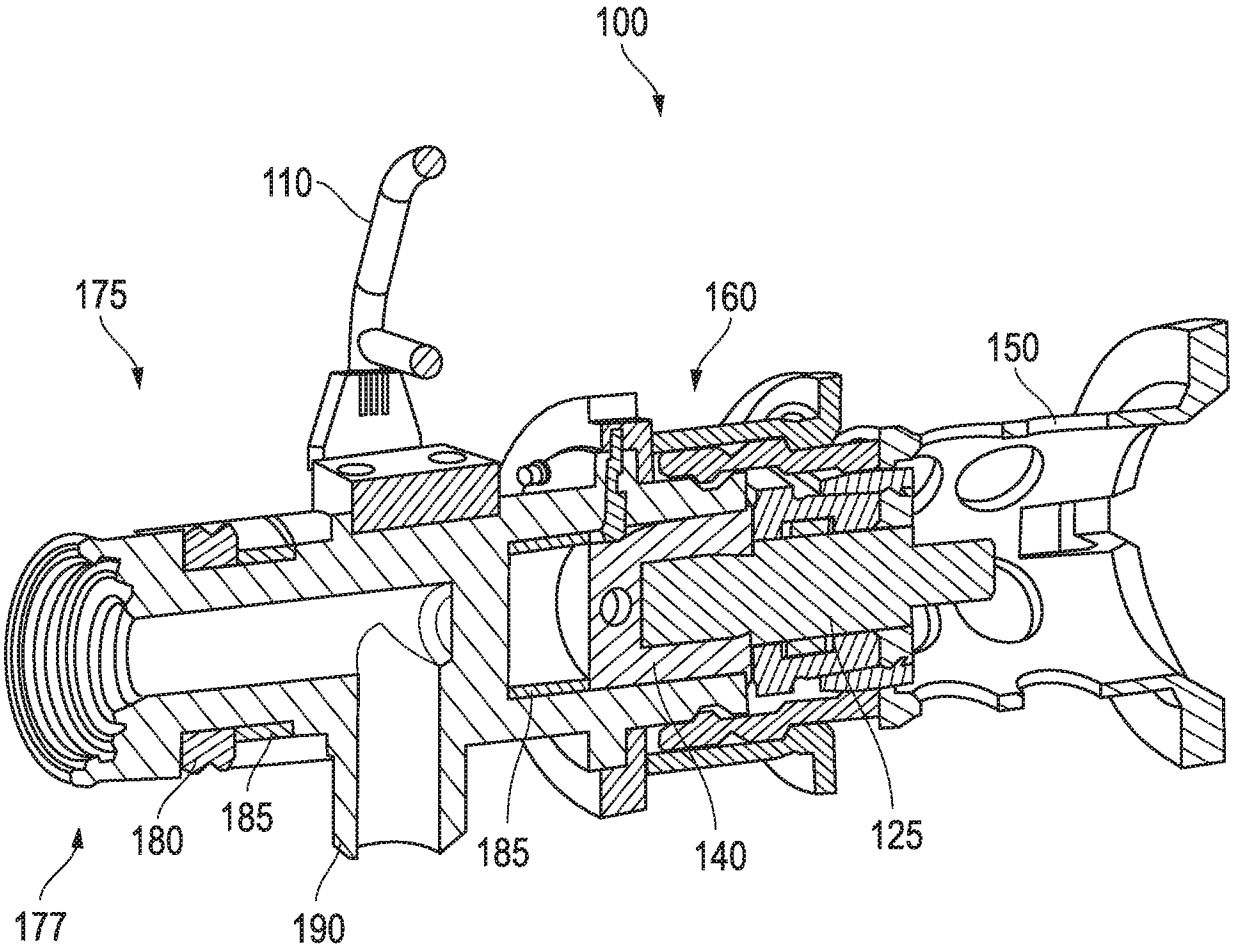
FIG. 1 is a perspective side cross-sectional view of an embodiment of a verifiable alignment bore connector.

Referring now to FIG. 1, a perspective side cross-sectional view of an embodiment of a verifiable alignment bore connector 100 is shown. With added reference to FIG. 2B, the connector 100 is configured to serve as a hydraulic coupling or bridge between a flowline 290 and subsea equipment such as a manifold 200 at a seabed 201. For example, a fluid termination 175 of the connector may include an inlet 190 which securely accommodates the flowline 290 and a seal end 177 for securely engaging at a receptacle 215 of the manifold 200. Thus, chemical injection fluid or other treatment fluid meant for use in an application at the manifold 200 may be reliably delivered from a tank at the seabed 201 or other appropriate location.

Figure 2A:
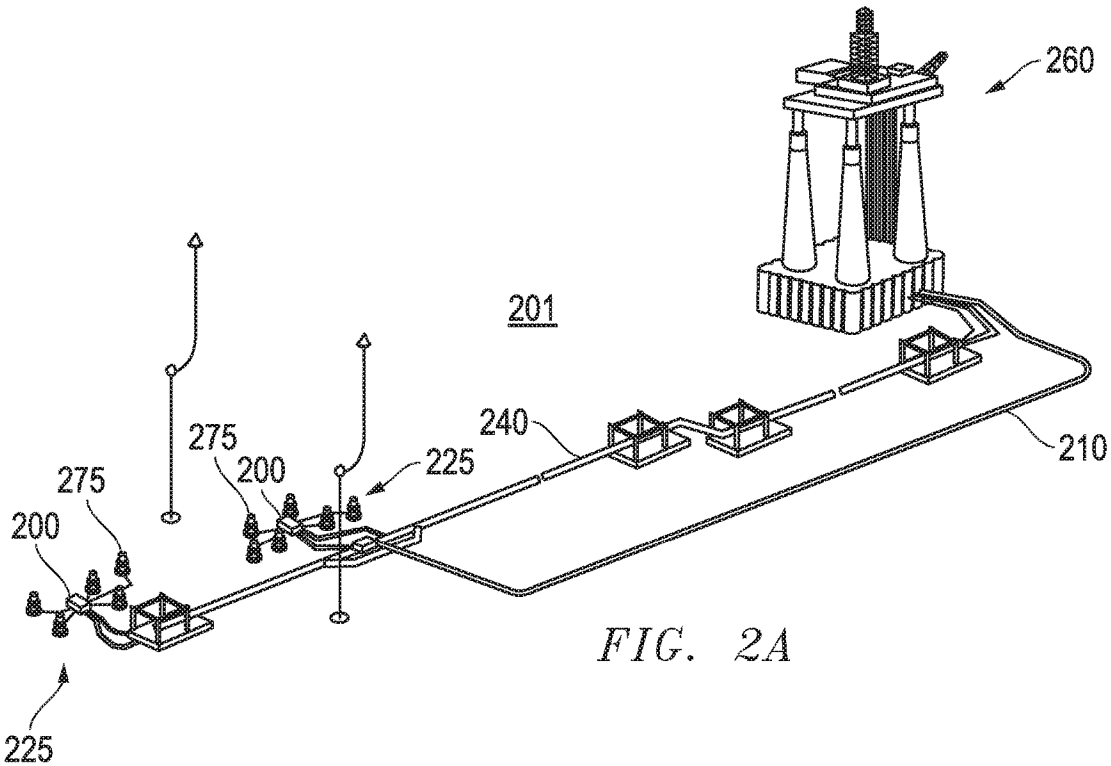
FIG. 2A is an overview of a subsea oilfield employing well clusters coupled to manifolds serviceable by the bore connector of FIG. 1.
Figure 2B:
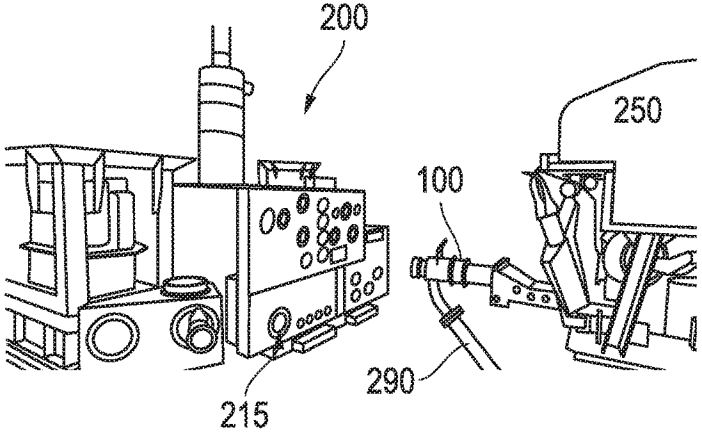
FIG. 2B is a perspective view of a remote operated vehicle (ROV) delivering the bore connector of FIG. 1 to a manifold of FIG. 2A.

Continuing with added reference to FIG. 2B, a remote operated vehicle (ROV) 250 may be used to secure and transport the connector 100 as indicated. Specifically, a torque bucket 150 may be secured at an arm of the ROV 250. Thus, as described further below, a torque tool of the ROV 250 may ultimately be used to achieve sealed secure engagement between at the receptacle 215. More specifically, a leadscrew 125 may be rotated to advance a circumferential mechanism 140 that is threaded at the interior thereof. In this way, the mechanism 140 may be advanced toward an actuator 185 that is used in setting latch dogs 180 during engagement.

Of course, in other embodiments, a circumferential mechanism in the form of an interiorly threaded rod or nut may be held in a stationary location and used to advance a linear leadscrew type of device in an opposite manner to the embodiment depicted in FIG. 1. However, in the embodiment of FIG. 1, advancement of the more circumferential feature (e.g. the mechanism 140) may be of unique structural soundness due to the type of engagement described. That is, the actuator 185 is also a circumferential device which is driven into circumferential engagement with the latch dogs 180 which are discrete, potentially finger-like, elements also occupying circumferential locations. This means that in the embodiment shown, the laterally moving parts utilized in attaining engagement are each circumferential (140, 185, 180), structurally linking up with one another in succession. On the other hand, the element which is not disposed at a circumferential location is the element that is kept laterally stationary (e.g. the rotatable leadscrew 125). Thus, as noted, a uniquely structurally sound mode of engagement may be achieved.

Continuing with reference to FIG. 1, the bore connector 100 includes a lift handle 110, for example to aid in manually securing the connector 100 to the ROV 250 in advance of deploying to the subsea environment. Additionally, a release sleeve 160 is provided which may be activated to retract the mechanism 140 to achieve disengagement of the latch dogs 180 and the entire connector 100 in a quicker fashion than merely reverse rotation of the leadscrew 125. So, for example, at the end of a chemical injection clean-out application or in the event of seal failure as discussed below, an efficient mode of disengagement may be readily available.

Referring now to FIG. 2A, an overview of a subsea oilfield is shown employing well clusters 225 coupled to manifolds 200 serviceable by the bore connector 100 of FIG. 1. This exemplary oilfield includes a conventional offshore platform 260 from which subsea operations may be directed. In this particular example, the operations may include using one well cluster 225 for injection and another 225 for production. Further, bundled water and production lines 240 and bundled electrical/hydraulic lines 210 may run along the seabed 201 between the platform 260 and the cluster locations.

Referring now to FIG. 2B, a perspective view of an ROV 250 delivering the bore connector 100 of FIG. 1 to a manifold 200 of FIG. 2A. Unlike a surface oilfield, lines and equipment located at a seabed 201 far below surface are often unavailable for simple manual servicing. Once more, in the example scenario of chemical injection treatment of a manifold 200, the ROV 250 is tasked with not only directing the connector 100 to a receptacle 215 at the manifold 200 but also with dragging a flowline 290 across the seabed 201. Even if the flowline 290 runs from a strategically placed treatment fluid tank at the seabed 201, it may still be hundreds or thousands of feet long to allow it to be taken from one manifold location to another as needed. While much of the load of the flowline 290 is absorbed by the seabed 201 itself, during positioning of the connector 100 at the receptacle 215, a substantial amount of load remains to be dealt with during aligning and orienting the connector toward and into the receptacle.

Figure 3:
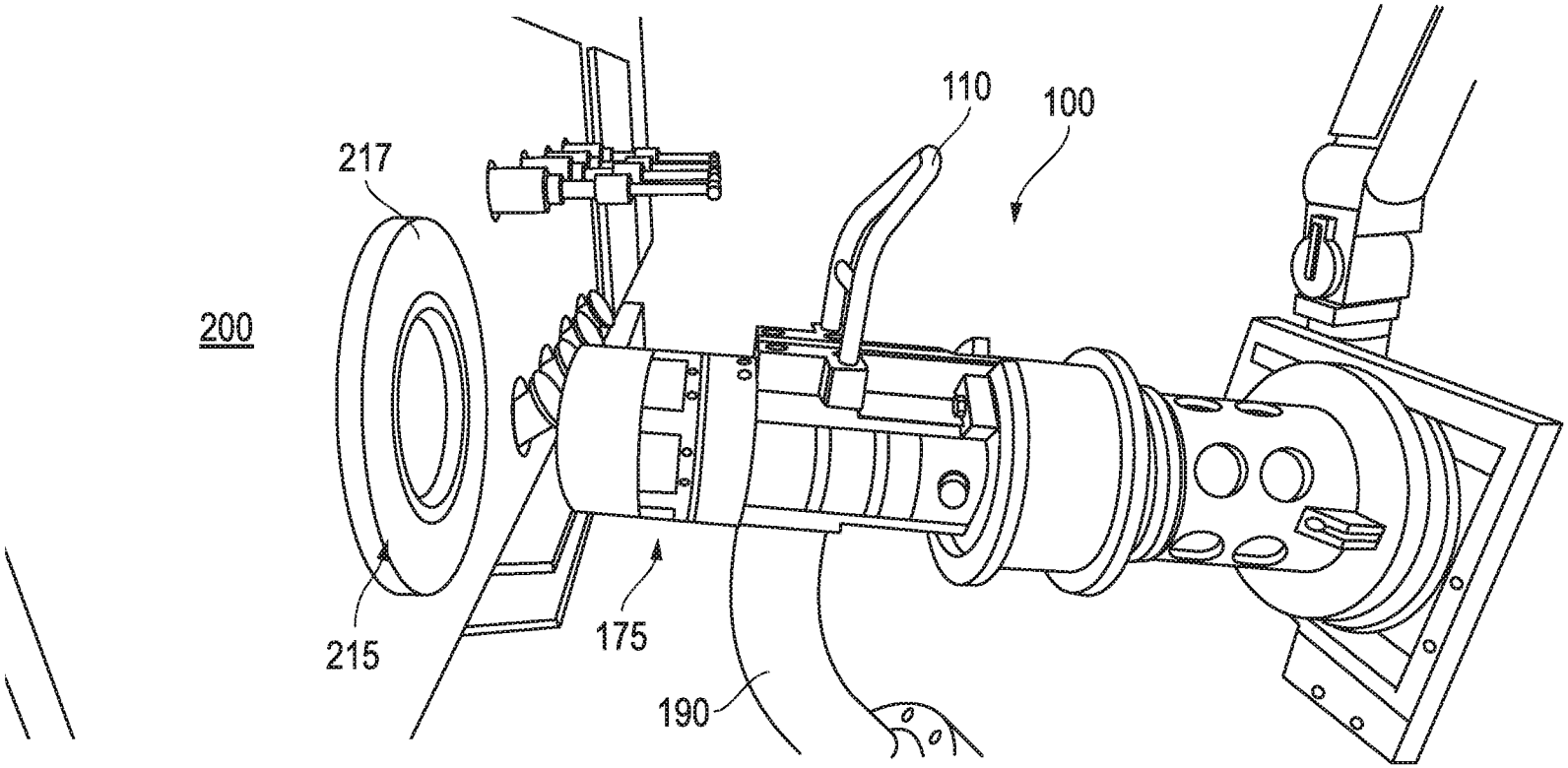
FIG. 3 is a perspective view of the bore connector of FIG. 2B reaching a receptacle at an outer landing hub of the manifold for coupling thereto.

Referring now to FIG. 3, a perspective view of the bore connector 100 of FIG. 2B reaching the receptacle 215 at an outer landing hub 217 thereof. In this illustration, the challenge of managing the above noted load is apparent. Specifically, as the fluid termination 175 of the connector 100 approaches the receptacle 215, it is angled. With added reference to FIGS. 2A and 2B, an operator of the ROV 250 may be stationed at the platform 260 and provided with visibility to the connector 100 and receptacle 215 through a camera on the ROV 250. However, as depicted, load on the inlet 190 of the connector 100 from the flowline 290 may have an impact on the orientation of the connector 100.

The operator may attempt to compensate for the noted load by altering elevation of the ROV 250 but the angular impact on the connector 100 may largely remain. Further, given that all of this is taking place remotely and in a subsea, current-filled environment, as a practical matter the odds of the connector 100 being plugged into the receptacle 215 in a perfectly horizontal fashion are not great. Nevertheless, as discussed below, unique techniques for attaining completed engagement between the connector 100 and the receptacle 215 are provided that may overcome the load and angular orientation issues described. For example, in one embodiment, the connector 100 would be able to attain reliable sealed engagement with the receptacle 215 as detailed below even where initial placement is angularly off-axis by up to 3° and with the connector 100 facing a load of up to 7,000 lbs. to overcome. Furthermore, in this scenario, the reliably sealed engagement may include attaining a pressure rating in excess of 15,000 PSI or more given the wide range of pressure differentials that may be found in the subsea environment and in light of an example treatment application as described.

Figure 4A:
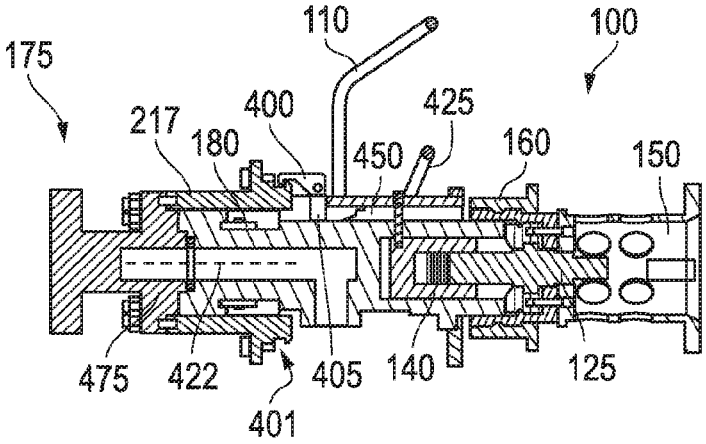
FIG. 4A is a side cross-sectional view of the bore connector of FIG. 3 aligned with the receptacle as verified by setting of an embodiment of a preliminary lock.
Figure 4B:
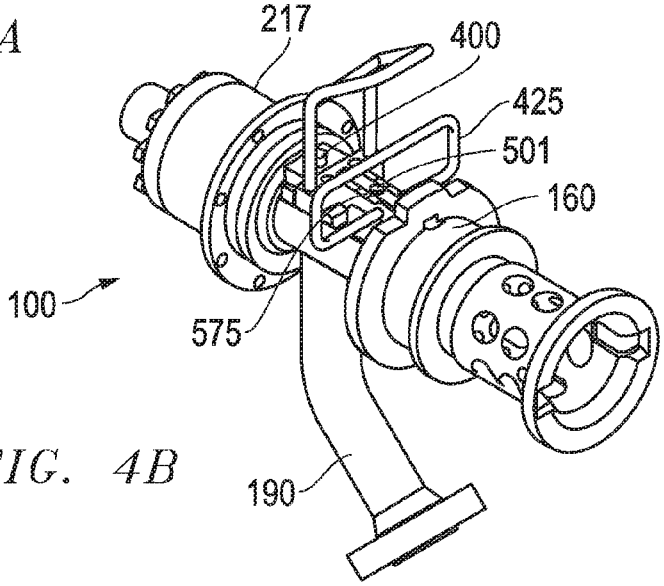
FIG. 4B is a perspective view of the bore connector with the set preliminary lock of FIG. 4A verifying the alignment.
Figure 4C:
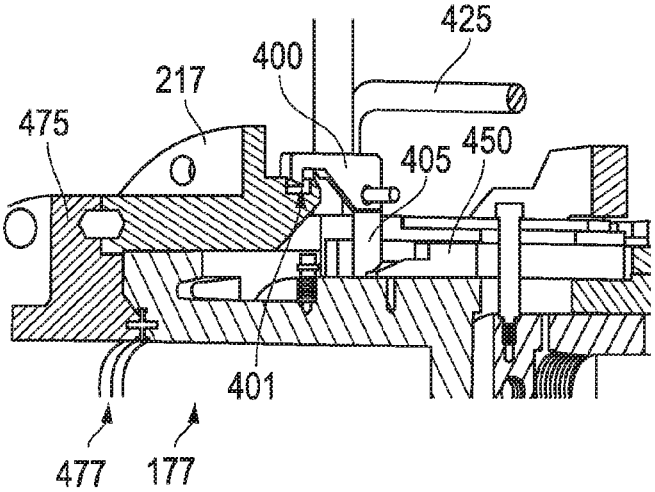
FIG. 4C is an enlarged cross-sectional view of the preliminary lock of FIGS. 4A and 4B and surrounding architecture upon setting.

Referring now to FIG. 4A, with added reference to FIG. 3, a side cross-sectional view of the bore connector 100 is shown aligned with the receptacle 215 from the landing hub 217 to an inboard hub 475 thereof. FIGS. 4B and 4C are perspective and enlarged cross sectional views of the same. The noted alignment is verified by a visual indicator in the form of a preliminary lock 400. More specifically, in the embodiment shown, the lock 400 is a passive, spring biased lock configured to engage with a retention groove 401 of the landing hub 217. Once more, the lock 400 and groove 401 are of a mating architecture such that when a predetermined alignment between the connector 100 and receptacle is not present, the lock 400 will not set at the groove 401. So, for example, in one embodiment, the lock 400 will set at the groove 401 when the connector 100 is within 10° of the central axis 422 of the receptacle 215 but will not set when the connector 100 is angled further off axis than this predetermined alignment.

As indicated, the setting of the lock 400 serves as a visual indicator that the alignment of the connector is within predetermined tolerances for beginning an engagement sequence for attaining a reliable secure seal as described further below. In terms of visualizing the setting of the lock 400, confirmation may be the operator through the camera on the ROV 250 (see FIG. 2B). Of course, other types of conventional confirmation may be utilized. Indeed, the confirmation of alignment within a predetermined angular tolerances need not involve any form of external locking device as depicted here. So long as some form of alignment confirmation is utilized in advance of seal engagement, appreciable benefit may be realized.

With specific reference to FIGS. 4A and 4B, the features of the connector 100, from the leadscrew 125 to the latch dogs 180 are as described above with respect to FIG. 1. However, in this embodiment, the addition of the lock 400 and groove 401 is also accompanied by a release mechanism 425. As shown, the mechanism 425 may be a lever 425 that is used to disengage the lock 400 from the groove 401 if need be. For example, at the end of a treatment application the lock 400 may be disengaged or if at the outset the operator is unsure of reliable or complete setting of the lock 400 and wishes to realign the connector 100. The release mechanism 425 may be pulled at the direction of an arm from the ROV 250 or other suitable means.

With specific reference to FIG. 4C, an incline at a leg 405 of the lock 400 may encounter a corresponding incline surface of a release actuator 450 when the release mechanism 425 is pulled as described above. Thus, the lock 400 may be pivotally disengaged from the groove 401 as also described. Of course, where there is no need for premature disengagement, a sealed interface 477 may be set at an interface between the seal end 177 of the connector 100 and the inboard hub 475 of the receptacle 215 according to an engagement sequence as described below.

Figure 5A:
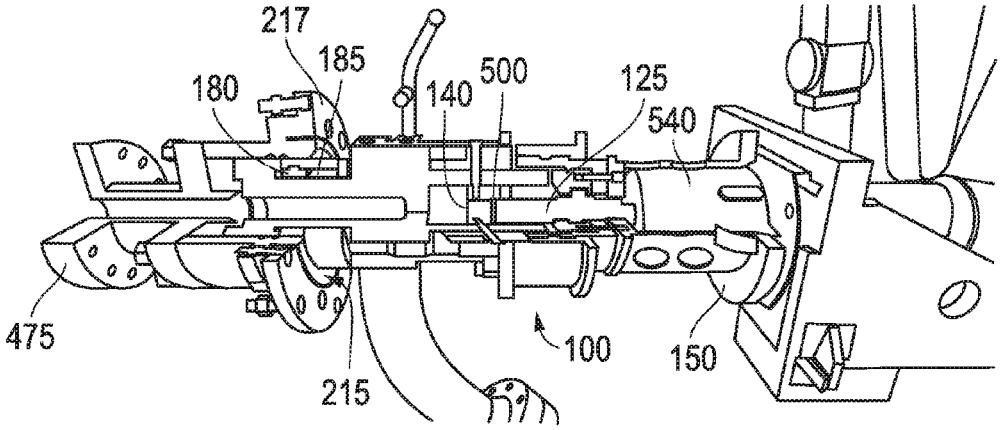
FIG. 5A is a partially cross-sectional view of the aligned bore connector upon initial setting of the preliminary lock as shown in FIGS. 4A-4C.

Referring now to FIG. 5A, a partially cross-sectional view of the aligned bore connector 100 is shown upon initial setting of the preliminary lock 400 as shown in FIGS. 4A-4C. With the proper alignment achieved and verified, a torque tool 540 may engage the leadscrew 125 to initiate the sealing engagement process. In the embodiment shown, the torque tool 540 may be a standard API 17H ISO compliant class 4 torque tool often employed in an ROV bucket 150 as shown. Notice that upon initially attaining proper alignment with the receptacle 215, the circumferential mechanism 140 remains immediately adjacent the leadscrew 125 with very little clearance 500. Ultimately, this means that the latch dogs 180 remain retracted and the sealed engagement has yet to be achieved. However, as noted below, this will change as the torque tool 540 begins to rotate the lead screw 125.

Figure 5B:
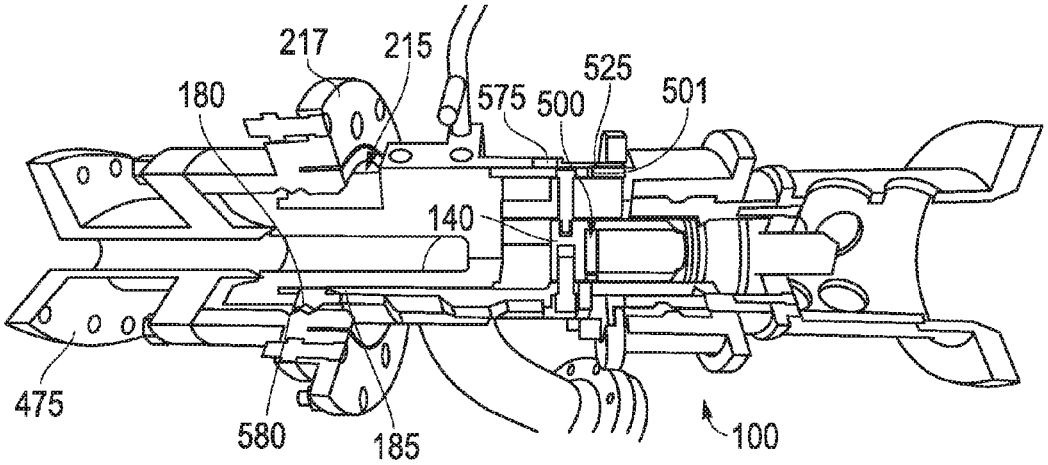
FIG. 5B is a partially cross-sectional view of the bore connector upon lead screw actuation to drive bore connector engagement with the receptacle at an inboard hub thereof.

Referring now to FIG. 5B, a partially cross-sectional view of the bore connector 100 is shown with the leadscrew 125 rotating to drive the threaded mechanism 140 toward the inboard hub 475. Notice the size of the clearance 500 increasing. As this occurs, the correspondingly circumferential actuator 185 begins to act upon the latch dogs 180 and start the process of setting the connector 100 within the receptacle 215. Ultimately, as discussed below, the latch dogs 180 will set within dog receivers 580 of the receptacle to complete the engagement.

Continuing with reference to FIG. 5B, as the leadscrew 125 rotates and initiates the engagement sequence, an operator directing the process may again be provided with useful visual confirmation information. Specifically, while the advancing circumferential mechanism 140 may not be clearly visible to the operator, the operator may nevertheless watch as an exposed mobile indicator 501 at an exterior location moves from one location to another. Indeed, rearward 525 and forward 575 stationary indicators that are not connected to the underlying mechanism 140 may be provided for reference. That is, at the outset and upon achieving suitable alignment, the mobile indicator 501 may be in alignment with the rearward stationary indicator 525. However, as the engagement process proceeds the mobile indicator 501 may move out of alignment with the rearward indicator 525. The operator may watch to ensure that the mobile indicator 501 comes into complete alignment with the forward indicator 575, for example before determining that the engagement is complete and ready for seal testing. For added illustration of such visual indication, note the perspective view of FIG. 4B, where the mobile indicator 501 is shown coming into alignment with the forward indicator 575 as described.

Figure 5C:
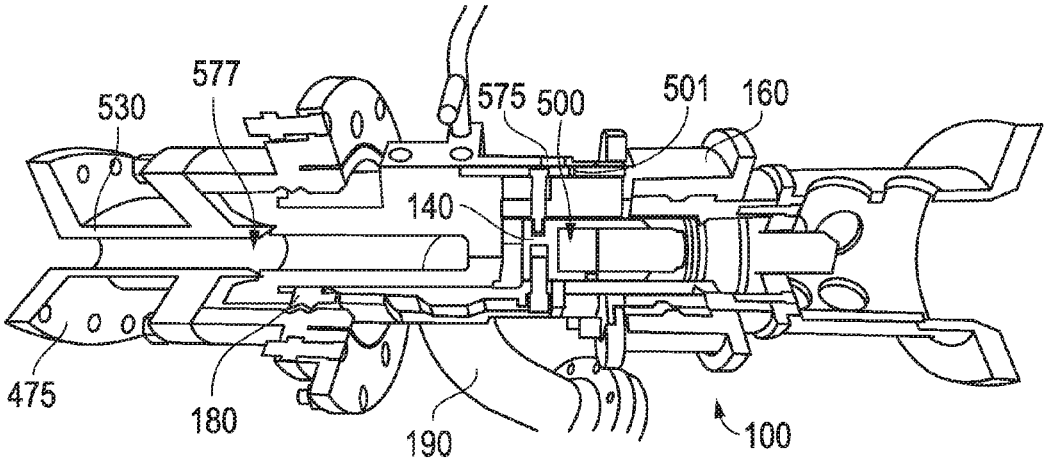
FIG. 5C is a partially cross-sectional view of the bore connector of FIG. 5B upon completed engagement with the inboard hub.

Referring now to FIG. 5C, a partially cross-sectional view of the bore connector 100 of FIG. 5B is shown upon substantially completed engagement with the inboard hub 475. In this depiction it is apparent that the latch dogs 180 have almost been completely set. Indeed, with some minor added forward advancement of the mobile indicator 501 into alignment with the forward stationary indicator 575, the clearance 500 will be maximized, the dogs 180 will be set and a reliably sealed interface 477 will be attained between the connector 100 and the inboard hub 475. In one embodiment, this may include a literal seal such as a metal to metal seal, perhaps in the form of a dual metal gasket. Though other suitable seal devices may be utilized. Additionally, once visual confirmation of the completed engagement is provided, back seal testing may be performed to confirm that the sealed interface will perform according to its designated rating (e.g. see backpressure line 530). Of course, if it is determined that the connector 100 and/or sealed interface 477 are defective or inadequate, the connector 100 may be quickly disengaged through actuation of the release sleeve 160 as noted above as opposed to waiting for the torque tool 540 to completely reverse the process.

Figure 6:
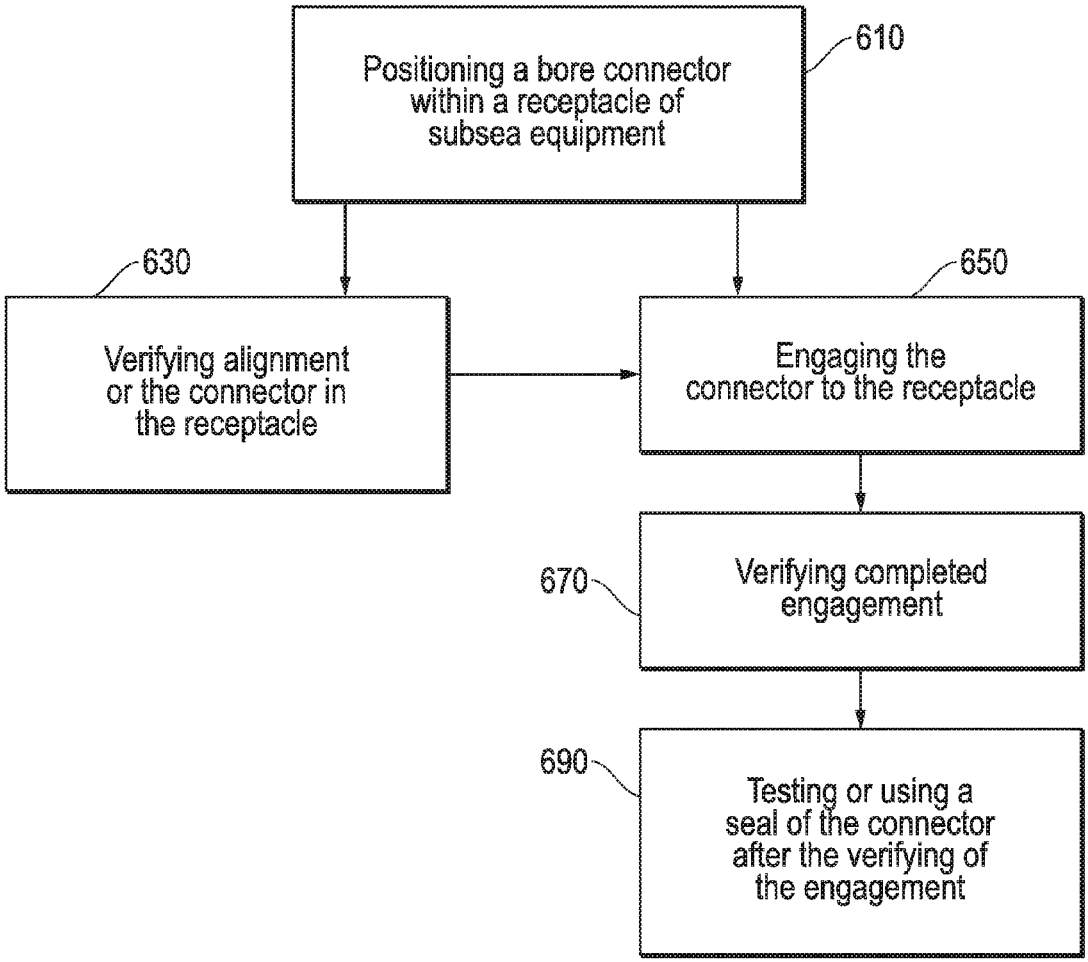
FIG. 6 is a flow-chart summarizing an embodiment of aligning and engaging a bore connector with a receptacle of subsea equipment.

Referring now to FIG. 6, a flow-chart is shown summarizing an embodiment of aligning and engaging a bore connector with a receptacle of subsea equipment. Upon initial positioning as indicated at 610, verifying alignment may take place before any driving of actual engagement between the connector and the receptacle (see 630). Thus, attaining a proper reliable engagement may be more assured. Additionally, in an embodiment where the verifying of alignment is achieved through a preliminary lock as described herein, the opportunity to pre-place the connector at the receptacle exists. So, for example, where a torque tool is not immediately available, connectors may be pre-placed at receptacles of subsea equipment with the preliminary lock serving to both verify alignment and to securely hold the corresponding connector until the torque tool is available.

After positioning of the connector, the engagement sequence may be actuated as indicated at 650, for example through use of a torque tool as described herein. Additionally, the engagement sequence, in particular the completion of engagement may be verified as indicated at 670. This may be achieved visually through tracking of a mobile indicator coming into alignment with a stationary forward indicator as detailed herein or through a variety of other means. Regardless, with verification of completed engagement the seal formed by the engagement may be tested and/or the connector put to use in a fluid application therethrough (see 690).

Embodiments described above provide a bore connector and techniques for engagement with a receptacle at subsea equipment that helps assure proper alignment in advance of engagement. Thus, the possibility of insufficient engagement for forming a reliable seal between the connector and the receptacle are dramatically reduced. Thus, not only is the application run through the bore safeguarded but so to is the equipment itself, the surrounding environment and overall subsea operations.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, subsea equipment accommodating a receptacle has been referenced herein as a manifold. However, subsea equipment may include a Christmas tree at a wellhead, a bore at a pipeline or a host of other subsea equipment. Similarly, the applications referenced herein are for sake of a chemical injection cleanout. However, gas lift or a variety of other applications may be run through a bore connector and techniques as described herein. Indeed, even applications and equipment at surface may benefit from the connector and techniques described herein. Furthermore, the foregoing description should not be read as pertaining only to the precise structures described and shown in the accompanying drawings, but rather should be read as consistent with and as support for the following claims, which are to have their fullest and fairest scope.

We claim:

1. A method of engaging a bore connector to a receptacle of subsea equipment, the method comprising:
aligning the connector with the receptacle;
verifying the alignment as within predetermined tolerances of the connector to the receptacle with a preliminary lock therebetween; and
engaging the connector to the receptacle after the verifying, the engaging sufficient for substantially sealing the connector at the receptacle.

2. The method of claim 1 wherein the predetermined tolerance comprises the connector being within 3° of an axis of the receptacle.

3. The method of claim 1 wherein the engaging of the connector to the receptacle comprises overcoming a load of up to 7,000 lbs. on the connector.

4. The method of claim 1 wherein substantially sealing the connector at the receptacle includes exhibiting a pressure rating in excess of about 15,000 PSI.

5. The method of claim 1 wherein the verifying of the alignment comprises:
securing the connector to the receptacle with the preliminary lock at a groove of a landing hub of the receptacle that is externally located on the subsea equipment; and
visibly confirming the securing.

6. The method of claim 5 wherein the bore connector, the receptacle, the landing hub and the groove are a first bore connector, first receptacle first landing hub and first groove, respectively, the method further comprising:
securing a second bore connector with a preliminary lock at a second groove of a second landing hub at a second receptacle prior to the engaging of the first bore connector to the first receptacle.

7. A method of engaging a bore connector to a receptacle of subsea equipment, the method comprising:
aligning the connector with the receptacle;
engaging the connector to the receptacle by securably sealing a seal end of the connector with the receptacle by way of a preliminary locking therebetween; and
verifying the locked engaging with reference to a visible mobile indicator moving into alignment with a visible stationary indicator.

8. The method of claim 7 wherein the engaging comprises employing a torque tool of a remote operated vehicle to rotate a leadscrew and advance a threaded circumferential mechanism to actuate setting of latch dogs, the mobile indicator to track with the advancement of the mechanism.

9. The method of claim 7 further comprising one of:
backpressure testing the sealing; and
performing a fluid application at the equipment through the connector.

10. A bore connector for engaging with a receptacle of subsea equipment, the connector comprising:
a fluid termination with an inlet for coupling to a flowline and a seal end to support the engaging with the receptacle; and an indicator selected from a group consisting of:
a visual alignment indicator to provide an operator confirmation of acceptable alignment between the seal end and the receptacle by way of locking therebetween in advance of the engaging with the receptacle; and
an engagement indicator to provide an operator confirmation of completion of the engaging between the seal end and the receptacle.

11. The bore connector of claim 10 wherein the subsea equipment is one of a manifold and a Christmas tree.

12. The bore connector of claim 10 wherein the receptacle comprises an inboard hub for interfacing the seal end at a seal upon completion of the engaging.

13. The bore connector of claim 12 wherein the seal is one of a metal to metal seal and a dual metal gasket.

14. The bore connector of claim 10 further comprising:
a leadscrew;

a circumferential mechanism threadably disposed about the leadscrew and for advancing toward the seal end upon rotation of the leadscrew;

an actuator interfacing the mechanism and for advancing toward the seal end upon the advancing of the mechanism; and at least one latch dog interfacing the actuator and for setting upon the advancing of the actuator to complete the engaging between the seal end and the receptacle.

15. The bore connector of claim 14 wherein the engagement indicator is a visible mobile indicator coupled to the circumferential mechanism and configured to move from alignment with a visible rearward stationary indicator of the connector into alignment with a visible forward stationary indicator of the connector during the engaging.

16. The bore connector of claim 10 wherein the receptacle comprises a landing hub at an exterior location of the subsea equipment and defining a retention groove to support locking of the preliminary lock thereat for the securing.

17. The bore connector of claim 16 further comprising a release mechanism to allow for disengagement of the preliminary lock from the retention groove.

18. The bore connector of claim 17 wherein the release mechanism is an operator directed handle coupled to a release actuator within the connector to actuate the disengagement.

* * * * *